United States Patent [19]

Miller

[11] 4,216,285

[45] Aug. 5, 1980

[54] MONOBATH PROCESSING OF COLOR FILM, INCLUDING OPTICAL SOUND

[76] Inventor: Harris R. Miller, 60 W. 68th St., Apt. 4E, New York, N.Y. 10023

[21] Appl. No.: 919,217

[22] Filed: Jun. 26, 1978

Related U.S. Application Data

[63] Continuation-in-part of Ser. No. 788,423, Apr. 18, 1977, abandoned.

[51] Int. Cl.[2] ..... G03C 7/24; G03C 5/38

[52] U.S. Cl. ..... 430/140; 430/364; 430/436; 430/456; 430/457

[58] Field of Search ..... 96/61 M, 4, 39, 55

[56] References Cited

U.S. PATENT DOCUMENTS

| | | | |
|---|---|---|---|
| 2,323,246 | 6/1943 | Schneider et al. | 96/39 |
| 3,705,800 | 12/1972 | Lane | 96/4 |
| 3,705,802 | 12/1972 | Baptista | 96/4 |
| 3,756,822 | 9/1973 | Sahyun | 96/61 M |
| 3,819,372 | 6/1974 | Newman et al. | 96/4 |

OTHER PUBLICATIONS

Haist, "Monobath Manual", p. 34, Morgan & Morgan, New York, 1966.

*Primary Examiner*—J. Travis Brown

*Attorney, Agent, or Firm*—Shlesinger, Fitzsimmons & Shlesinger

[57] ABSTRACT

An aqueous photographic tri-color processing monobath, which includes a color developer and a fixing agent, and which has a pH of about 10.6, is capable of color developing and fixing an exposed photographic film, without requiring any bleaching of the developed film. Moreover, apparently due to the compact morphology of the residual silver, it has been discovered that a monobath of the type disclosed is suitable for producing both an unobscured dye image and a silver plus dye sound track in a single processing step.

4 Claims, 1 Drawing Figure

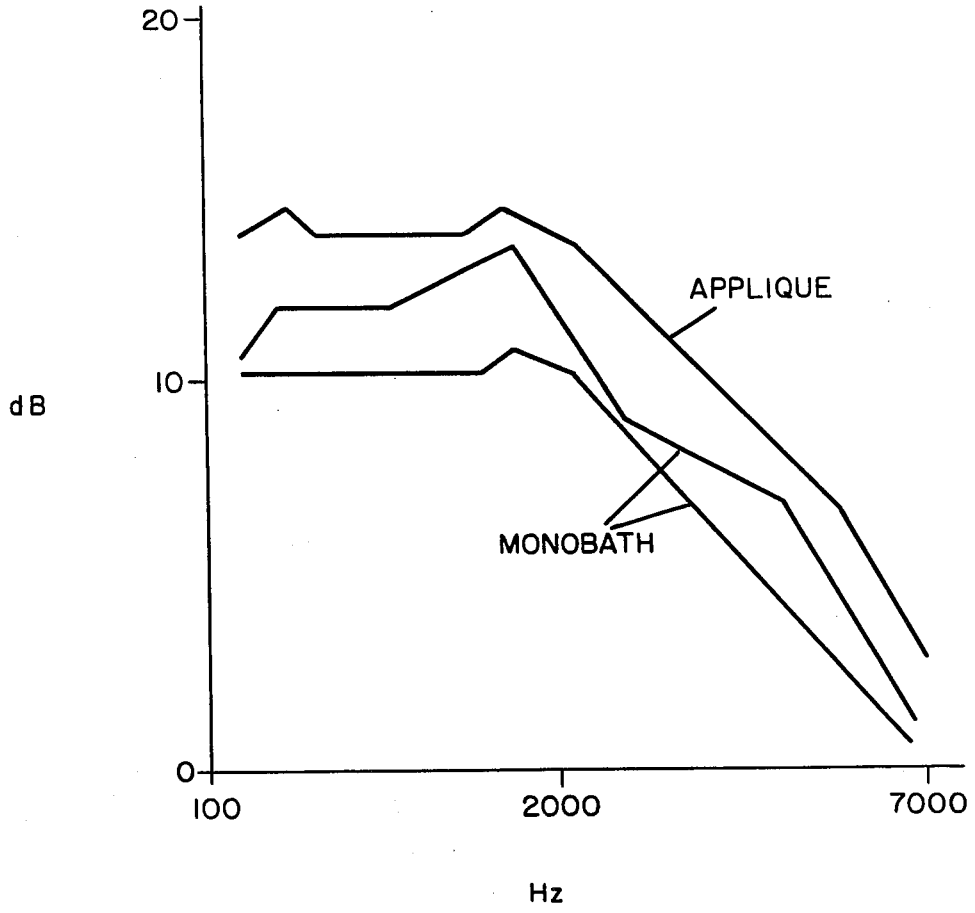
20
10
0
dB
APPLIQUE
MONOBATH
100
2000
7000
Hz

MONOBATH PROCESSING OF COLOR FILM, INCLUDING OPTICAL SOUND

This application is a continuation-in-part of my copending U.S. application Ser. No. 788,423, filed April 18, 1977, now abandoned.

It relates to rapid color processing and more particularly to a novel, single solution process for developing and fixing a full color, commercially available film product. Even more particularly this invention relates to a color monobath for processing conventional color motion picture film to produce a print having both a desired dye image and a suitable optical sound track formed from residual silver.

One previous attempt to prepare a monobath for color development, which would permit both color development and fixing in the same solution, was misled by the following empirical relationship:

$$f = \mathrm{pH} + \log(K_L/[L]x)$$

wherein f is a measure of the relative rate of physical development, $K_L$ is the dissociation constant of the silver complex which results from reaction of the fixing agent with silver halide (expressed in $(\text{moles})^x/(\text{liters})^x$), and [L] is the concentration of fixing agent in moles per liter. The variable "x" represents the number of ions derived from the fixing agent which are associated with a single silver ion in the complex. For an alkali metal thiosulfate fixing agent, for example, x is 2. When the term f is greater than 1.0, the concomitant metallic silver is reported to be invisible for magnifications of the image less than about 500 times, obviating the need to remove the silver metal.

For example, U.S. Pat. No. 3,756,822 discussed the above relationship and the problems of monobaths of reduced pH and their tendency to provide images having significantly visible metallic silver, a factor which obscures the color image and degrades the color saturation. Thus a color monobath having a pH of no less than about 13.2 was believed to be a necessity for the formation of satisfactory color saturation in the inventor's exclusive color photographic element. A monobath for photographic color processing (avoiding separate development, bleaching and fixing steps) is, of course, greatly to be desired.

The U.S. Pat. No. 3,923,511, while primarily concerned with production of a monobath in which all unused silver was completely bleached and fixed, thus leaving no residual silver, suggested that in the absence of such bleaching and fixing the unused silver, the resultant dye image would be completely unsatisfactory. Contrary to these teachings as noted hereinafter, applicant has found that a monobath of the proper composition not only will produce a satisfactory image without any bleaching stage, but also will leave residual silver at high exposure levels, in quantities sufficient to enable the production of an optical sound track on the developed film, but insufficient, as far as covering power is concerned, to interfere with or otherwise obscure the developed dye image.

The current practice of optical sound reproduction for the motion picture industry involves special processing for only a fraction of the film width. This is produced by application of a viscous developer to the film edge. This developer deposits silver metal which modulates a radiometric diode, having sensitivity at 850 nm. Although it has been shown that silver is not needed for accurate sound reproduction, previous attempts to convert the industry to dye-track sound have failed.

Other disadvantages of the viscous-developer-applique are possible spreading into the image portion and splashing of the viscous developer at high film processing rates. Also, viscous application is impossible for smaller format motion picture such as super and regular 8 mm.

It is an object of the present invention, therefore, to provide a stable, efficient monobath for rapid photographic color processing, specifically tailored to a full color, commercially available film product.

Another object of the invention is to provide a photographic color processing monobath which has a moderate pH, but which nevertheless produces a full developed color image 98% free of any visible silver image.

Another object of the invention is to provide a photographic color monobath producing a dye image in which the concomitant metallic silver is of such a low covering power that it does not interfere with the quality of the dye image, yet is present in sufficient quantities at high exposure levels to enable the formation on the film of an optical sound track.

Still a more specific object of this invention is to eliminate the heretofore common practice of appliquing the edge of motion picture film during processing by providing a monobath which will leave enough silver for producing the sound track without the addition of silver for this specific purpose.

Other objects of the invention will be apparent hereinafter from the specification and from the recital of the appended claims, particularly when read in conjunction with the accompanying drawing.

In the drawing, the single FIGURE shows the frequency response curves for two sound tracks processed in the color monobath made according to the teachings of this invention, and a third sound track processed by a conventional ECP-2 processing using a viscous developer applique.

The following process enables rapid-access color development of an exposed silver halide photographic element. It comprises treating the element in an aqueous solution having a pH of about 10.6 and which includes a primary amine developer and a fixing agent capable of reacting with silver halide in said element to form primarily $Na(Ag_3(S_2O_3)_2).H_2O$, at concentrations of 0.01–0.50 moles per liter of an alkali metal thiosulfate with the solution being stable at said pH. The method of this invention has been satisfactorily practiced on color tri-pack films, for example the commercially available Eastman Color Positive Print Film type 5381 and 7383. It is preferably carried out at a temperature of about 32° C.

The developing agent utilized in the present invention is of the primary aromatic amine type and is specifically 2-Amino-5-diethylaminotoluene Monohydrochloride (CD-2). The fixing agent is an alkali metal thiosulfate, and preferably sodium thiosulfate.

Two types of development, which are caused by the developing agent, compete in the color monobath. The initial reaction is chemical development due to primary aromatic amine developers which experience no induction period. This developing agent also produces the second type of reaction known as physical development. This is because of the high solvency action to silver halide of the developing agent alone.

The ratio of chemical to physical development is controlled by the silver ions in solution conveniently made available by the developing agent and fixing agent. Chemical development produces filamentary silver with good covering power, where physical development produces considerably less visible silver deposits, unobscuring formation of the dyes.

Previous attemps for monobath processing of color tri-pack films failed to slow the rate of solubilization to that which is equal to the rate of development. With the present invention the two reaction rates are matched, so that the concentration gradients of both reactants will be identical through the depth of the tripack emulsion. This is effected by proper formulation and inclusion of an alkali metal thiosulfate, only at concentrations less than 0.05 moles per liter. In this way the rates of development can be matched so that the uppermost layer of the color tri-pack is not partially solubilized with respect to other layers, thus permitting the use of commercial products and obviating the need to manufacture tailored color emulsions.

Chemical development is initiated with the developing agent without induction effects, and is terminated by the fixing agent shifting development from the chemical to the physical process of image formation by solubilizing the silver halide. This is known as the clearing time of the emulsion. (See *Monobath Manual* by G. M. Haist, Hastings-on-Hudson: Morgan and Morgan, Inc., 1966, pp. 14,15.).

It will be understood that the success of this monobath formulation lies in the high silver ion concentration achieved by low concentrations of bromide and thiosulfate ions at respectively 0.016 and 0.050 moles per liter. A high silver ion concentration is maintained by a low thiosulfate ion concentration as indicated by the following relationship:

$$K_{mn} = \frac{[Ag+]^m [H^z]^n}{[Ag_n H_m]^{mz+n}}$$

where H is some ion or molecule such as bromide or thiosulfate which carries a charge Z and the state of equilibrium between the complex and its dissociation products are controlled by the law of mass action. (See *The Theory of Photographic Process*, Mees & James, 3rd Ed., the Macmillan Co., N.Y., N.Y. 1966, pg. 8.).

When the fixation rate is measured as the reciprocal of the clearing time, the concentration of thiosulfate ion is found to be directly proportional to the rate of fixation over the range of 0.0125–1.80 moles per liter. (*The Theory of Photographic Process*, id.) This would discount the previous believed theory that low concentrations of thiosulfate tend to suppress the silver concentration within the monobath.

Best dye formation is obtained at a pH of about 10.6. A higher pH promotes a deamination reaction which produces the quinone-monimine form of the color developer. Such a reaction will change the hue of the dye, eliminating the possibility of photographic reproduction. Therefore, a pH higher than 10.6 is undesirable.

The monobaths of the present invention have been found capable of greatly reducing the time required for conventional color processing. For example, utilizing a color tri-pack emulsion, the total processing time can be reduced from 50 minutes to about 5 minutes. The exposed film need only be treated in a monobath of the invention to cause development of a colored image and fixation of unreduced silver halide, and washed to remove the processing chemicals from the film.

Serious drawbacks of monobath formulations for black and white emulsions are the loss of sensitivity experienced with this type of processing. Here, sensitivity losses are due to the low covering power of silver in the toe region of the characteristic curve. This produces a low density in the toe region where the sensitivity is measured.

Although much more silver is formed in the toe region by monobath processing, as compared to conventional processing, the covering power is low, hence the optical density is also low. This approach should predict an increase in sensitivity of color emulsions processed in color monobaths relative to conventional processing since the dye formation is directly proportional to the silver formation regardless of its covering power.

Sensitivity of the Eastman Color Print Film type 5381 when processed in a monobath formulation of this invention is equal to the sensitivity of the photographic element when processed conventionally. This occurs in one embodiment at a processing temperature of 32° C. and pH of about 10.6. These factors result in a precise control of the reactants as they diffuse through the tri-pack emulsion in an effort to balance the rate of dye formation of the three emulsions.

A superadditive development combination may be utilized by adding to the color developer 0.010 grams per liter of 1-phenyl-3-pyrazolidone. Such superadditive combinations are useful in reducing loss of latent image by highly active development combination in a highly solvent solution. Ideally a fixing agent should dissolve the silver halide without attaching the silver of the image. Sodium thiosulfate does not completely fulfill this requirement, inasmuch as it does attach the silver of the image to some extent, the rate of solution being greatest when the silver is in the finest state of division.

The invention may be more clearly understood by reference to the following illustrative example of the novel monobath composition:

EXAMPLE 1

| A solution of: | Approximate wt. in grams |
|---|---|
| Sodium sulfite | 4.0 |
| 1-phenyl-3-pyrazolidone | 0.010 |
| 2-Amino-5-diethylaminotoluene Monohydrochloride (CD-2) | 3.0 |
| Sodium Carbonate | 18.0 |
| Potassium Bromide | 2.0 |
| Sodium thiosulfate | 7.0 |
| Sodium sulfate | 65.0 |
| Water to | 1000.0 ml |
| pH | 10.6 |

The monobath of EXAMPLE 1 was prepared for processing of Eastman Color Print Film type 5381 that was separately exposed to 2.50 log exposure units measured in meter-candle-seconds, using #92-red, #93-green and #94-blue separation filters producing analytical dye densities of cyan, magenta, and yellow. The photographic element was processed for 5 minutes at 32° C. Agitation was vigorous for the first 30 seconds and normal for 5 seconds every 30 seconds. Densities were read using a Macbeth TD-504 densitometer of the cyan, magenta, and yellow dyes using, respectively, #25-red,#58-green and #74-blue color filters.

TABLE 1

| Process | Dmin | Gamma-red | Gamma-green | Gamma-blue |
|---|---|---|---|---|
| Monobath | 0.10 | 2.7 | 2.4 | 2.2 |
| Conventional | 0.08 | 2.4 | 2.4 | 2.4 |

It will be noted that the pH in Example 1 is a full 2.6 pH units lower than the 13.2 minimum heretofore thought to be necessary to produce satisfactory saturation of color dyes. The surprising result is that, given the solution set forth in Example 1, one skilled in the art would never expect that the presence of the sodium thiosulfate in a solution of this low a pH would produce a fully developed image and also obviate the need of having to get rid of undesirable silver metal. Moreover, film processed in this manner has the advantage that its remaining or concomitant silver can be utilized to produce an optical sound track in the film.

For example, an Eastman Color Print Film type 7383 (Element 1) was exposed in a Bell & Howell 6100Cl Cine Printer. Trimmer settings were adjusted to produce a neutral density of about 1.0; when printed from an Eastman 7247 negative. Element 1 also received exposure suitable for producing a variable-area-optical-sound-track. A 7247 negative having a sound-track density of 2.4 was used to expose Element 1. The color temperature of the exposing illumination was adjusted by filtration to restrict the density to the top two layers (green and red) of the integral-tri-pack.

The composite print (Element 1A) was processed in a novel color monobath of the type set forth in the above EXAMPLE 1, which is capable of development and fixation; and a control print was processed by conventional ECP-2 processing (Element 1B). The monobath of this invention induces physical development at a significantly higher rate than conventional color developers. The reduced silver formed in the image-wise-exposure-area has about half of the covering power resulting from conventional color developers.

Decibel values were measured from Elements 1A & 1B. The independent variable was twelve, discrete, frequencies ranging from 100–7,000 Hz. A frequency response curve (see the drawing) was generated from the dB levels recorded on a voltage meter. The voltage was modulated by a radiometric diode having infra-red sensitivity. A #S-58 filter was used for recording the infra-red density.

The accompanying drawing shows the frequency response curves for two sound-tracks processed in the color monobath of this invention and a third sound-track processed by conventional ECP-2 processing using a viscous-developer-applique.

Subjective tests measuring harmonic distortion, showed no statistical difference for a comparison between the monobath processed, sound-track and a viscous-applique, sound-track using a 0.05 alpha risk. The infra-red density of the viscous applique sound-track and the monobath sound-tracks are, respectively: 1.26, 1.25 and 1.22.

In evaluating the curves shown in the drawing the cause for an overall decrease in the monobath frequency response is probably due to the insufficient rem-jet-backing, removal system for the monobath processed sound-track. The carbon remaining from backing contributed to 0.10 density. Since carbon absorbs in the infra-red region, the density ratio for the variable area sound-track decreased.

The color monobath of this invention produces residual silver having a completely different morphology from conventional developers. Instead of silver platelets produced by conventional, chemical development, the monobath's high silver ion concentration produces silver having a compact morphology. This silver obstructs the dye image by as little as 1–3% at a net density of 1.0. By exposing the color print film to correspond with a dye density of about 4.0, an infra-red density (850 nm) of about 1.25 is produced. This is because chemical development plays a significant role at densitites above 3.0. Therefore, the silver formed on the shoulder of the characteristic curve has a covering power similar to that found in conventional development. Covering power is defined as the optical density divided by the mass of silver per unit area.

Since the covering power of the silver is low for densities less than about 3.0 and higher for densities greater than about 3.0, an unobscured dye image and dye-plus-silver sound-track can be produced using the monobath of EXAMPLE 1. Since the dye is transparent to radiation at 850 nm, the radiometric diode, which was referred to above in connection with the applique method, detects only the silver-metal. Processing need only be complete by rinsing the color monobath from the film and drying the developed film.

In summary, Eastman Color Print Film type 7383 may be exposed and processed in a color monobath of this invention to produce a composite print in which silver metal is retained within the film matrix. The covering power of the silver is about half of the covering power resulting from conventional color developers. (*Photographic Science and Engineering,* Vol 5, No. 4, 1961, pp. 204–210.) The reduced covering power enables the production of an unobscured dye image; while producing enough silver, at higher exposure levels, to modulate an optical-sound-track. The optical-sound-track produced in accordance with this invention is shown to have similar response and distortion when compared to a composite print produced by conventional ECP-2 processing (in combination with a viscous, sound-track-applique). Color monobath processing eliminates the need to applique the film edge, for producing optical sound.

Although others have suggested that the presence of silver is not needed for accurate sound reproduction (*Journal of the SMPTE,* Vol. 73, pp 936–938) the desirability of having silver present for this purpose cannot be gainsaid. Since physical development and color monobath processing are known to produce enhanced edge effects, it follows that equal or better sound reproduction is possible with sound tracks processed in a color monobath of this invention. This has the advantage that the local application to the sound-track area during processing is not necessary, and this unexpected result is accomplished without any alterations to sound playback systems.

While in Example 1 specific quantities are suggested, it is to be understood that they have been given by way of one specific example in which the quantity of sodium thiosulfate, for example, may be in the range of 7 to 11 gr./l, and 1-phenyl-3-pyrazolidone in the range of 0.01 to 0.025 gr/l.

While this invention has been described in detail in connection with only certain embodiments thereof, it will be apparent that it is capable of further modification, and that this application is intended to cover any such further modifications which fall within the scope of one skilled in the art or the appended claims.

Having thus described my invention, what I claim is:

1. A method of producing from an exposed, multicolor, photographic film element of the type containing silver halide, and suited for use in producing colored motion picture film, a composite print having thereon an unobscured dye image and an optical sound track of the dye plus silver variety, comprising, simultaneously, developing a color dye image and a dye plus silver optical sound track on said element in an aqueous monobath, and while the element is still in the monobath, fixing the dye image and sound track without bleaching the image and sound track areas, and washing the developed and fixed element, said monobath having a pH of less than 13.2, and containing in solution an aromatic amine developing agent, and an alkali metal thiosulfate fixing agent in concentrations of less than approximately 0.05 moles per liter of thiosulfate.

2. A method of developing and fixing an exposed film element as defined in claim 1, wherein the composition of said monobath is as follows:

| A solution of: | Approximate wt. in grams |
|---|---|
| Sodium sulfite | 4.0 |
| 1-phenyl-3-pyrazolidone | 0.010 |
| 2-Amino-5-diethylaminotoluene Monohydrochloride (CD-2) | 3.0 |
| Sodium Carbonate | 18.0 |
| Potassium Bromide | 2.0 |
| Sodium thiosulfate | 7.0 |
| Sodium sulfate | 65.0 |
| Water to | 1000.0 ml |

3. A method as defined in claim 2, including processing said element in said monobath for approximately 5 minutes at 32° C., with periodic agitation of the element.

4. A method as defined in claim 1, including; prior to the development step, subjecting the film element to an exposure suitable for producing a variable area optical sound track.

* * * * *